US006089726A

United States Patent [19]

Eldridge, Jr.

[11] Patent Number: 6,089,726

[45] Date of Patent: Jul. 18, 2000

[54] LAMP SHADE HEATER DEVICE

[76] Inventor: James Eldridge, Jr., 710 Autum Brook Cir., Sherwood, Ark. 72120

[21] Appl. No.: 09/186,255

[22] Filed: Nov. 5, 1998

[51] Int. Cl.[7] ..... F21V 29/00; F21V 33/00

[52] U.S. Cl. ..... 362/96; 362/294; 362/373; 362/253; 362/92; 219/220

[58] Field of Search ..... 362/294, 373, 362/351, 96, 359, 92; 55/385.1; 432/77; 165/61; 219/220; 392/375

[56] References Cited

U.S. PATENT DOCUMENTS 1,889,567 11/1932 Persons ..... 362/294
3,786,575 1/1974 Riblett ..... 219/220
4,665,472 5/1987 Chang ..... 362/294
4,974,126 11/1990 Hwang ..... 362/96
5,683,167 11/1997 Tarlow ..... 362/96

*Primary Examiner*—Thomas M. Sember

[57] ABSTRACT

A lamp shade heater device for providing a heating source on a lamp shade. The lamp shade heater device includes a lamp shade with open top and bottom ends, and an inner surface defining an inner space. The lamp shade has a support frame designed for mounting the lamp shade on a lamp. A fan with an impeller is provided in the inner space of the lamp shade. A coiled heating element is coupled to the inner surface of the lamp shade.

15 Claims, 3 Drawing Sheets

LAMP SHADE HEATER DEVICE

BACKGROUND OF THE INVENTION

1. Field of the Invention

The present invention relates to lamp shade devices and more particularly pertains to a new lamp shade heater device for providing a heating source on a lamp shade.

2. Description of the Prior Art

The use of lamp shade devices is known in the prior art. More specifically, lamp shade devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,665,472; U.S. Pat. No. 4,816,970; U.S. Pat. No. Des. 345,436; U.S. Pat. No. 3,246,139; U.S. Pat. No. 4,747,031; and U.S. Pat. No. 4,745,532.

While these devices fulfill their respective, particular objectives and requirements, the aforementioned patents do not disclose a new lamp shade heater device. The inventive device includes a lamp shade with open top and bottom ends, and an inner surface defining an inner space. The lamp shade has a support frame designed for mounting the lamp shade on a lamp. A fan with an impeller is provided in the inner space of the lamp shade. A coiled heating element is coupled to the inner surface of the lamp shade.

In these respects, the lamp shade heater device according to the present invention substantially departs from the conventional concepts and designs of the prior art, and in so doing provides an apparatus primarily developed for the purpose of providing a heating source on a lamp shade.

SUMMARY OF THE INVENTION

In view of the foregoing disadvantages inherent in the known types of lamp shade devices now present in the prior art, the present invention provides a new lamp shade heater device construction wherein the same can be utilized for providing a heating source on a lamp shade.

The general purpose of the present invention, which will be described subsequently in greater detail, is to provide a new lamp shade heater device apparatus and method which has many of the advantages of the lamp shade devices mentioned heretofore and many novel features that result in a new lamp shade heater device which is not anticipated, rendered obvious, suggested, or even implied by any of the prior art lamp shade devices, either alone or in any combination thereof.

To attain this, the present invention generally comprises a lamp shade with open top and bottom ends, and an inner surface defining an inner space. The lamp shade has a support frame designed for mounting the lamp shade on a lamp. A fan with an impeller is provided in the inner space of the lamp shade. A coiled heating element is coupled to the inner surface of the lamp shade.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new lamp shade heater device apparatus and method which has many of the advantages of the lamp shade devices mentioned heretofore and many novel features that result in a new lamp shade heater device which is not anticipated, rendered obvious, suggested, or even implied by any of the prior art lamp shade devices, either alone or in any combination thereof.

It is another object of the present invention to provide a new lamp shade heater device which may be easily and efficiently manufactured and marketed.

It is a further object of the present invention to provide a new lamp shade heater device which is of a durable and reliable construction.

An even further object of the present invention is to provide a new lamp shade heater device which is susceptible of a low cost of manufacture with regard to both materials and labor, and which accordingly is then susceptible of low prices of sale to the consuming public, thereby making such lamp shade heater device economically available to the buying public.

Still yet another object of the present invention is to provide a new lamp shade heater device which provides in the apparatuses and methods of the prior art some of the advantages thereof, while simultaneously overcoming some of the disadvantages normally associated therewith.

Still another object of the present invention is to provide a new lamp shade heater device for providing a heating source on a lamp shade.

Yet another object of the present invention is to provide a new lamp shade heater device which includes a lamp shade with open top and bottom ends, and an inner surface defining an inner space. The lamp shade has a support frame designed for mounting the lamp shade on a lamp. A fan with an impeller is provided in the inner space of the lamp shade. A coiled heating element is coupled to the inner surface of the lamp shade.

Still yet another object of the present invention is to provide a new lamp shade heater device that has a fan to blow warmer air downwards so that a person next to the lamp may be warmed by heat from the lamp shade device.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
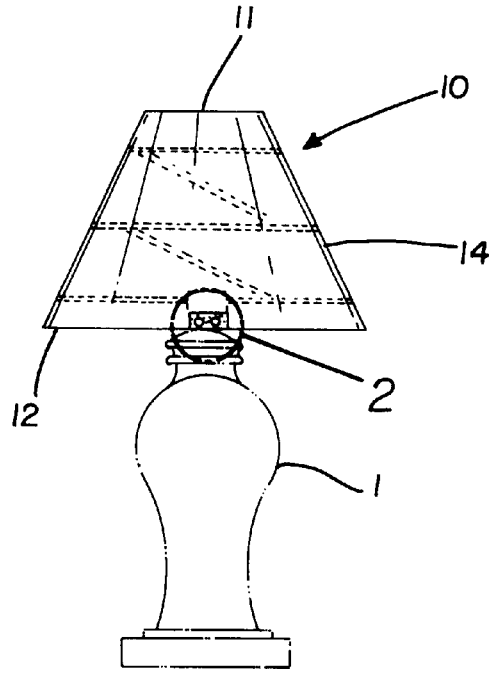
FIG. 1 is a schematic side view of a new lamp shade heater device in use according to the present invention.

With reference now to the drawings, and in particular to FIGS. 1 through 6 thereof, a new lamp shade heater device embodying the principles and concepts of the present invention will be described.

As best illustrated in FIGS. 1 through 6, the lamp shade heater device generally comprises a lamp shade 10 with open top and bottom ends 11,12, and an inner surface 13 defining an inner space. The lamp shade 10 has a support frame 15 designed for mounting the lamp shade 10 on a lamp 1. A fan 23 with an impeller is provided in the inner space of the lamp shade 10. A coiled heating element 25 is coupled to the inner surface 13 of the lamp shade 10.

In closer detail, the lamp shade 10 has open top and bottom ends 11,12, and inner and outer surfaces 13,14. The inner surface 13 of the lamp shade 10 defines an inner space. In an ideal embodiment, the lamp shade 10 is generally frusto-conical and the top and bottom ends 11,12 are each generally circular and have a diameter. Ideally, the diameter of the bottom end 12 of the lamp shade 10 is at least twice the size of the diameter of the top end 11 of the lamp shade 10 to optimally let the fan 23 blow warm air downwards through the bottom end 12 and to help minimize the amount of warm air rising through the top end 11 of the lamp shade 10.

The lamp shade 10 has a support frame 15 designed for mounting the lamp shade 10 on a lamp 1. The support frame 15 comprises an upper frame portion 16 and a harp frame portion 17. The upper frame portion 16 is positioned at the top end 11 of the lamp shade 10 and has a plurality of support arms 18 outwardly radiating from a center point of the top end 11 of the lamp shade 10. The harp frame portion 17 has an upper portion coupled to the upper frame portion 16 and a lower portion comprising a pair of mounting arms 19 designed for mounting to a lamp 1 such that the lamp shade 10 is mounted on the lamp.

The top end 11 of the lamp shade 10 preferably has a radially inwards extending annular upper skirt portion 20 covering a portion of the opening through the top end 11 of the lamp shade 10. The upper skirt portion 20 is designed for blocking heat in the inner space of the lam p shade 10 from escaping upwards from the lamp shade 10. The upper skirt portion 20 of the top end 11 of the lamp shade 10 defining a central upper opening 21. The top end he of the lamp shade 10 preferably has a grid-like screen 22 substantially covering the central upper opening 21 defined by the upper skirt portion 20. The screen 22 defining a plurality of spaces of a predetermined size therethrough to let air pass through the screen 22 while preventing passage therethrough of objects greater than the predetermined size such as a person's hand. Preferably, the upper skirt portion 20 and the screen 22 lie in generally parallel planes with one another. Optionally, the upper skirt portion 20 and the screen 22 generally lie in a common plane with one another.

Figure 4:
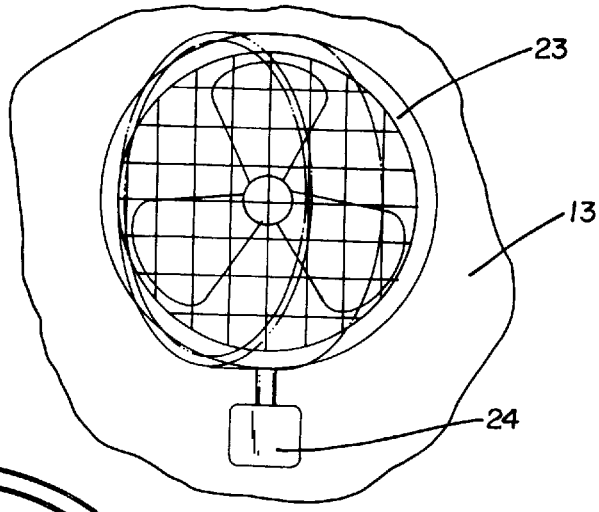
FIG. 4 is a schematic partial side view of an embodiment of the present invention with a fan pivotally mounted to the inner surface of the lamp shade between the top and bottom ends of the lamp shade.
Figure 5:
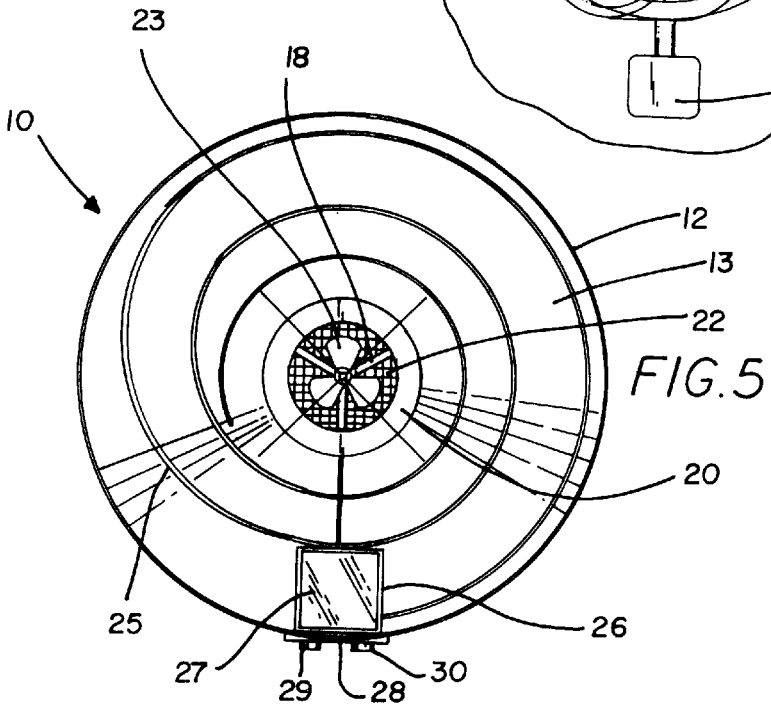
FIG. 5 is a schematic bottom view of the present invention.
Figure 6:
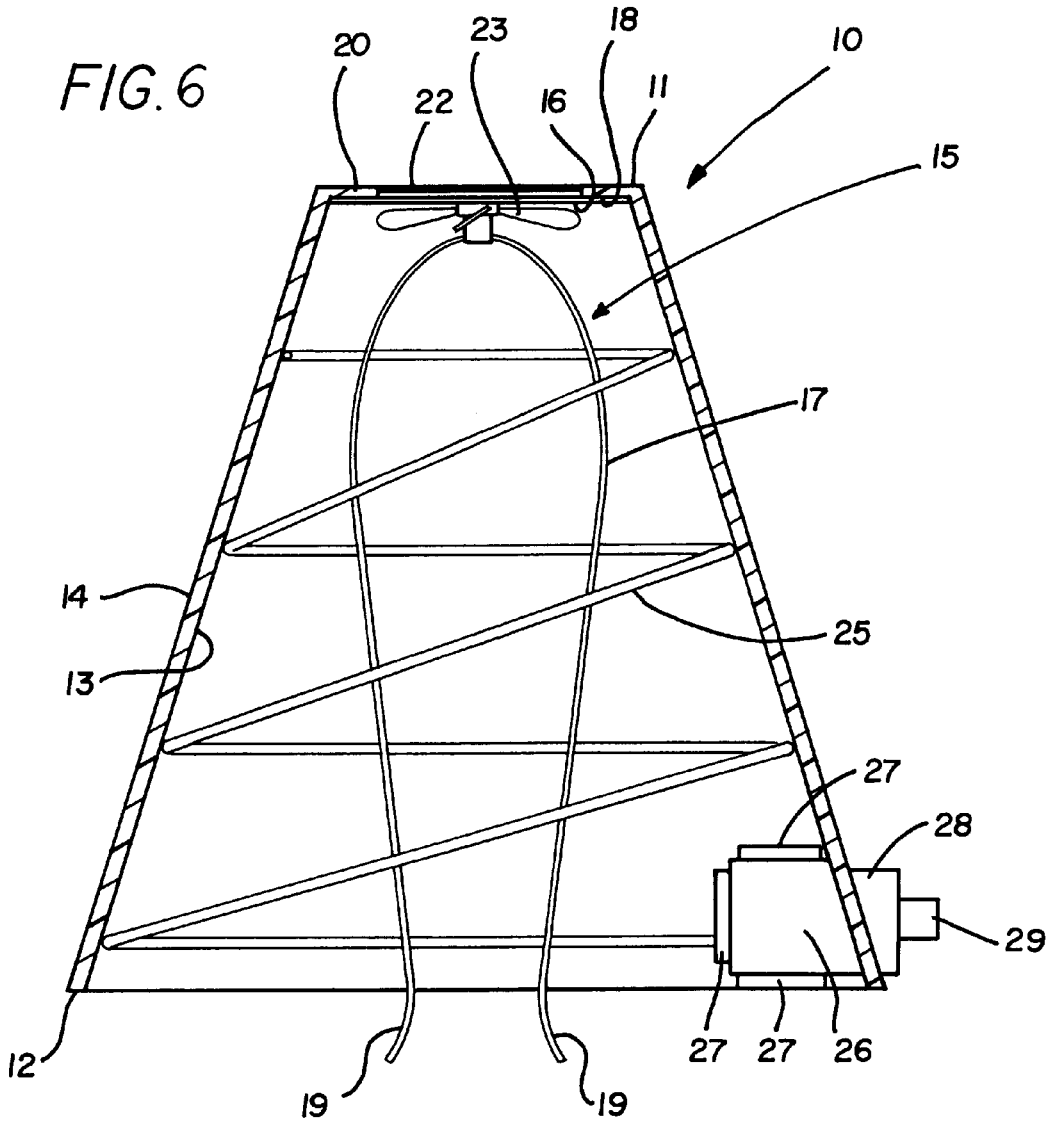
FIG. 6 is a schematic cross-sectional view of the present invention.

The fan 23 has an rotating impeller and is provided in the inner space of the lamp shade 10. The fan 23 is positioned adjacent the top end 11 of the lamp shade 10. In a preferred embodiment, the fan 23 is mounted to the upper frame portion 16 at the center point of the top end 11 of the lamp shade 10. In use, the fan 23 is designed for blowing warm air in the inner space of the lamp shade 10 downwards through the bottom end 12 of the lamp shade 10. Optionally, as illustrated in FIG. 4, the fan 23 may be pivotally mounted by a pivot mount 24 to the inner surface 13 of the lamp. In this embodiment, the fan 23 is pivotable in a plane in the inner space generally parallel to the top and bottom ends 11,12 of the lamp shade 10.

The inner surface 13 of the lamp shade 10 has a coiled heating element 25 coupled thereto. The heating element 25 preferably spirals upwards around the inner surface 13 of the lamp shade 10 from the bottom end 12 of the lamp shade 10 towards the top end 11 of the lamp shade 10. The heating element 25 is designed for providing heat when energized. Ideally, the spiral has at least three turns for optimizing the amount of heat provided by the heating element 25 in the inner space.

A power source is electrically connected to the heating element 25 to energize the heating element 25. The power source is also preferably electrically connected to the fan to provide energy to rotate the impeller.

Preferably, the power source comprises a cubical inner housing 26 is provided in the inner space of the lamp shade 10 and coupled to the inner surface 13 of the lamp shade 10. In this embodiment, the inner housing 26 is preferably positioned adjacent the bottom end 12 of the lamp shade 10. The inner housing 26 has a plurality of photo-voltaic cells 27 provided thereon, ideally on the top, sides, and bottom of the inner housing. The photo-voltaic cells 27 are electrically connected to the heating element 25 and the fan. The photo-voltaic cells 27 is designed for converting radiant energy from a light bulb of a lamp in the inner space into electrical energy for energizing the heating element 25 and the fan.

Optionally, the inner housing 26 may include a battery power source therein electrically connected to the heating element 25 and the fan for energizing the heating element 25 to provide heat when the light bulb of the lamp is off. Also optionally, the heating element 25 and the fan may be electrically connectable to an electrical receptacle by a power cord extending from the inner housing.

Figure 2:
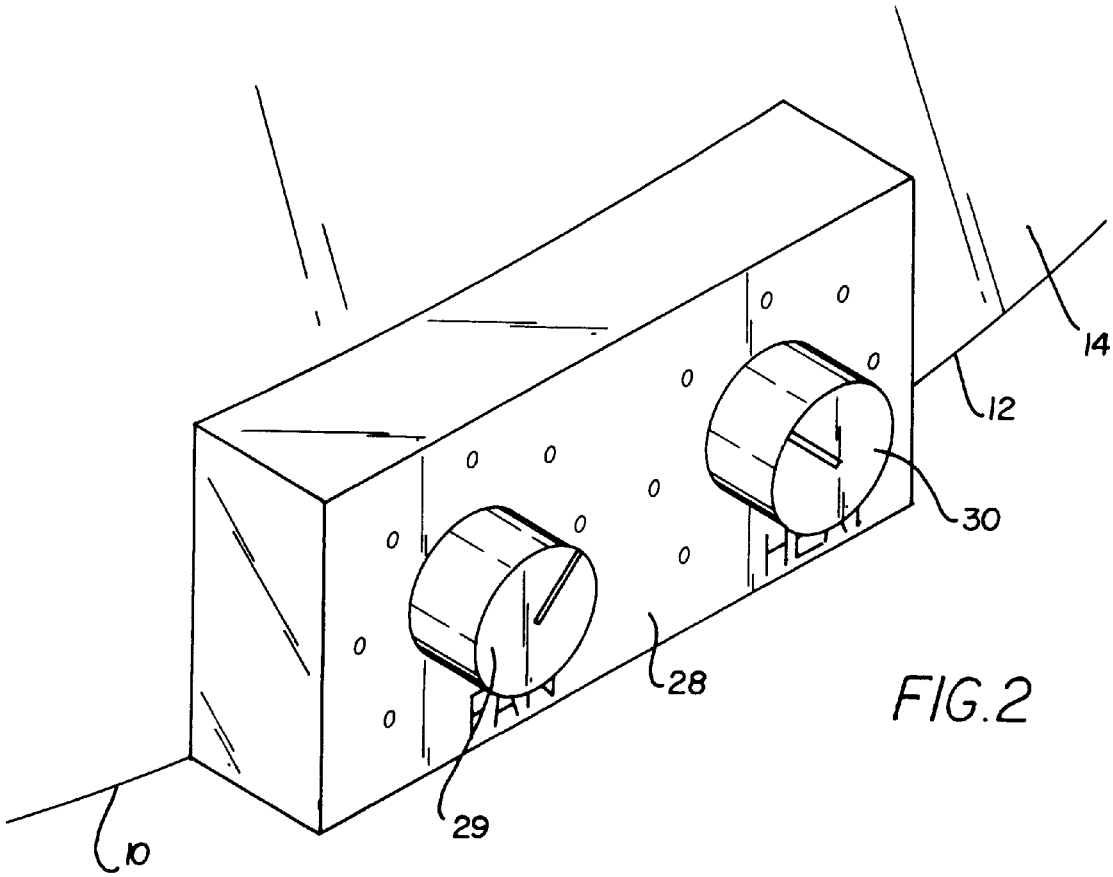
FIG. 2 is a schematic enlarge view taken from the circle 2 on FIG. 1 of the outer housing.
Figure 3:
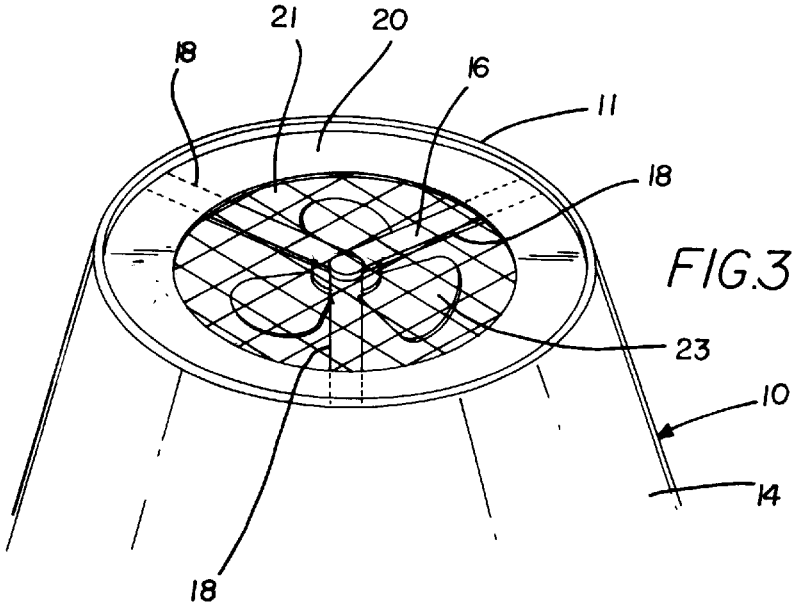
FIG. 3 is a schematic partial perspective view of the top of the present invention.

As illustrated in FIG. 2, the rectangular outer housing 28 is coupled to the outer surface 14 of the lamp shade 10. The outer housing 28 is preferably positioned adjacent the bottom end 12 of the lamp shade 10. The outer housing 28 has a pair of controls (preferably dial type controls) thereon. A first of the controls 29 is electrically connected to fan 23 for permitting selective control of the speed the impeller is rotated and includes a switch for turning the fan 23 on and off. A second of the controls 30 is electrically connected to heating element 25 for permitting selective control of the amount of heat provided by the heating element 25 and includes a switch for turning the heating element 25 on and off.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for mounting to a lamp, comprising:

a lamp shade having open top and bottom ends, and inner and outer surfaces, said inner surface of said lamp shade defining an inner space;

said lamp shade having a support frame adapted for mounting said lamp shade on a lamp;

a fan having an impeller being provided in said inner space of said lamp shade; and wherein said inner surface of said lamp shade has a coiled heating element coupled thereto; wherein said heating element spirals upwards around said inner surface of said lamp shade from said bottom of said lamp of shade towards said top end of said lamp shade.

2. The device of claim 1, further comprising a power source being electrically connected to said heating element to energize said heating element, said power source comprising an inner housing being provided in said inner space of said lamp shade and being coupled to said inner surface of said lamp shade, said inner housing having a plurality of photo-voltaic cells provided thereon, said photo-voltaic cells being electrically connected to said heating element.

3. The device of claim 1, further comprising an outer housing being coupled to said outer surface of said lamp shade, said outer housing having a control electrically connected to heating element for permitting selective control of the amount of heat provided by said heating element.

4. The device of claim 1, wherein said lamp shade is generally frusto-conical and said top and bottom ends are each generally circular and have a diameter, wherein said diameter of said bottom end of said lamp shade is at least twice the diameter of said top end of said lamp shade.

5. The device of claim 1, wherein said support frame comprises an upper frame portion and a harp frame portion, said upper frame portion being positioned at said top end of said lamp shade and having a plurality of support arms outwardly radiating from a center point of said top end of said lamp shade, said harp frame portion having an upper portion being coupled to said upper frame portion, said harp frame portion having a lower portion adapted for mounting to a lamp such that said lamp shade is mounted on the lamp.

6. The device of claim 1, wherein said top end of said lamp shade having a radially inwards extending annular upper skirt portion covering a portion of the opening through said top end of said lamp shade, said upper skirt portion of said top end of said lamp shade defining a central upper opening.

7. The device of claim 6, wherein said top end of said lamp shade has a screen substantially covering said central upper opening defined by said upper skirt portion.

8. A lamp shade heater device for mounting to a lamp, comprising:

a lamp shade having open top and bottom ends, and inner and outer surfaces, said inner surface of said lamp shade defining an inner space, wherein said lamp shade is generally frusto-conical and said top and bottom ends are each generally circular and have a diameter, wherein said diameter of said bottom end of said lamp shade is at least twice the diameter of said top end of said lamp shade;

said lamp shade having a support frame adapted for mounting said lamp shade on a lamp, wherein said support frame comprises an upper frame portion and a harp frame portion, said upper frame portion being positioned at said top end of said lamp shade and having a plurality of support arms outwardly radiating from a center point of said top end of said lamp shade, said harp frame portion having an upper portion being coupled to said upper frame portion, said harp frame portion having a lower portion adapted for mounting to a lamp such that said lamp shade is mounted on the lamp;

said top end of said lamp shade having a radially inwards extending annular upper skirt portion covering a portion of the opening through said top end of said lamp shade, said upper skirt portion of said top end of said lamp shade defining a central upper opening;

said top end of said lamp shade having a screen substantially covering said central upper opening defined by said upper skirt portion;

said upper skirt portion and said screen lying in generally parallel planes with one another, wherein said upper skirt portion and said screen generally lie in a common plane with one another;

a fan having an impeller being provided in said inner space of said lamp shade;

said fan being positioned adjacent said top end of said lamp shade, said fan being mounted to said upper frame portion at said center point of said top end of said lamp shade, said fan being adapted for blowing air in said inner space of said lamp shade downwards towards said bottom end of said lamp shade;

said inner surface of said lamp shade having a coiled heating element coupled thereto, said heating element spiraling upwards around said inner surface of said lamp shade from said bottom end of said lamp shade towards said top end of said lamp shade, said heating clement being adapted for providing heat when energized;

a power source being electrically connected to said heating element to energize said heating element;

said power source comprising an inner housing being provided in said inner space of said lamp shade and being coupled to said inner surface of said lamp shade, said inner housing being positioned adjacent said bottom end of said lamp shade;

said inner housing having a plurality of photo-voltaic cells provided thereon, said photo-voltaic cells being electrically connected to said heating element;

an outer housing being coupled to said outer surface of said lamp shade, said outer housing being positioned adjacent said bottom end of said lamp shade; and said outer housing having a pair of controls thereon, a first of said controls being electrically connected to fan for permitting selective control of the speed said impeller is rotated, a second of said controls being electrically connected to heating element for permitting selective control of the amount of heat provided by said heating element.

9. A device for mounting to a lamp, comprising:

a lamp shade having open top and bottom ends, and inner and outer surfaces, said inner surface of said lamp shade defining an inner space;

said lamp shade having a support frame adapted for mounting said lamp shade on a lamp;

a fan having an impeller being provided in said inner space of said lamp shade; and wherein said inner surface of said lamp shade has a heating element coupled thereto; wherein said heating element spirals upwards around said inner surface of said lamp shade from said bottom of said lamp of shade towards said top end of said lamp shade.

10. The device of claim 9, further comprising a power source being electrically connected to said heating element to energize said heating element, said power source comprising an inner housing being provided in said inner space of said lamp shade and being coupled to said inner surface of said lamp shade, said inner housing having a plurality of photo-voltaic cells provided thereon, said photo-voltaic cells being electrically connected to said heating element.

11. The device of claim 9, further comprising an outer housing being coupled to said outer surface of said lamp shade, said outer housing having a control electrically connected to heating element for permitting selective control of the amount of heat provided by said heating element.

12. The device of claim 9, wherein said lamp shade is generally frusto-conical and said top and bottom ends are each generally circular and have a diameter, wherein said diameter of said bottom end of said lamp shade is at least twice the diameter of said top end of said lamp shade.

13. The device of claim 9, wherein said support frame comprises an upper frame portion and a harp frame portion, said upper frame portion being positioned at said top end of said lamp shade and having a plurality of support arms outwardly radiating from a center point of said top end of said lamp shade, said harp frame portion having an upper portion being coupled to said upper frame portion, said harp frame portion having a lower portion adapted for mounting to a lamp such that said lamp shade is mounted on the lamp.

14. The device of claim 9, wherein said top end of said lamp shade having a radially inwards extending annular upper skirt portion covering a portion of the opening through said top end of said lamp shade, said upper skirt portion of said top end of said lamp shade defining a central upper opening.

15. The device of claim 14, wherein said top end of said lamp shade has a screen substantially covering said central upper opening defined by said upper skirt portion.

* * * * *